US006116890A

United States Patent [19]

Sors

[11] Patent Number: 6,116,890

[45] Date of Patent: Sep. 12, 2000

[54] PRESS FOR FORMING PELLETS

[75] Inventor: Michel Sors, Roquenaure, France

[73] Assignee: Commissariat A L'Energie Atomique, Paris, France

[21] Appl. No.: 09/162,296

[22] Filed: Sep. 28, 1998

[30] Foreign Application Priority Data

Oct. 2, 1997 [FR] France ..... 97 12273

[51] Int. Cl.[7] ..... B30B 11/02

[52] U.S. Cl. ..... 425/352; 425/415

[58] Field of Search ..... 425/352, 73, 77, 425/210, 415

[56] References Cited

U.S. PATENT DOCUMENTS

| | | | |
|---|---|---|---|
| 2,342,772 | 2/1944 | Wellman | 425/78 |
| 2,821,748 | 2/1958 | Willi | 425/215 |
| 3,659,985 | 5/1972 | Marshall et al. | 425/352 |
| 4,140,453 | 2/1979 | John, Jr. | 425/73 |
| 4,447,198 | 5/1984 | Long et al. | 425/415 |
| 4,631,015 | 12/1986 | Shigeo et al. | 425/352 |

FOREIGN PATENT DOCUMENTS

| | | | |
|---|---|---|---|
| 80245 | 1/1993 | Czechoslovakia | 425/352 |
| 341502 | 11/1910 | France . | |
| 2 038 800 | 1/1971 | France . | |
| 20 18 790 | 4/1971 | Germany . | |
| 5-2095 | 1/1993 | Japan | 425/352 |
| 376 772 | 5/1964 | Switzerland . | |
| 207681 | 3/1968 | U.S.S.R. | 425/352 |
| 997 901 | 7/1965 | United Kingdom . | |

*Primary Examiner*—Robert Davis
*Attorney, Agent, or Firm*—Pearne & Gordon LLP

[57] ABSTRACT

The pellets are formed in an opening (2) of a cylindrical die (1) by the approach of two punches (3 and 4). One of the two jacks (5', 8) necessary for performing the desired movements is contained in the rod of the other. The overall dimensions and weight of the press are very small, particularly as no additional guidance is required.

3 Claims, 2 Drawing Sheets

PRESS FOR FORMING PELLETS

The invention relates to a press for forming pellets.

Presses of this type comprise a perforated, cylindrical die and two punches sliding in the opening of the die in order to define a closed cavity, in which the powder to be tamped for forming a pellet is poured and then compressed. Long punch and pressure paths are required when the powder to be tamped has a limited density. The external dimensions of presses constructed in a conventional manner must be considerable with heights of-several metres, corresponding to weights of several tonnes, which are then considered to be normal. This disadvantage is aggravated in the case encountered by the present applicant, where the pellets are of nuclear fuel, which must not be exposed to the open air. It is then necessary to construct a protective enclosure around the press, when the latter has been assembled and installed.

The object of the invention is a much more compact and light press, which can be easily manipulated and which can be introduced into ordinary protective enclosures through normal openings.

This is achieved by means of a particular construction of the press comprising, like conventional presses, a cylindrical, pellet shaping die, two punches sliding in an opening of the die and two jacks having bodies and mobile rods, the first punch being integral with the rod of the first jack, but here the body of the first jack is integral with the die and the rod of the second jack, the body of the second jack is integral with the second punch, the rod of the first jack being guided by the rod of the second jack and the rod of the second jack guided by the body of the second jack.

Figure 1:
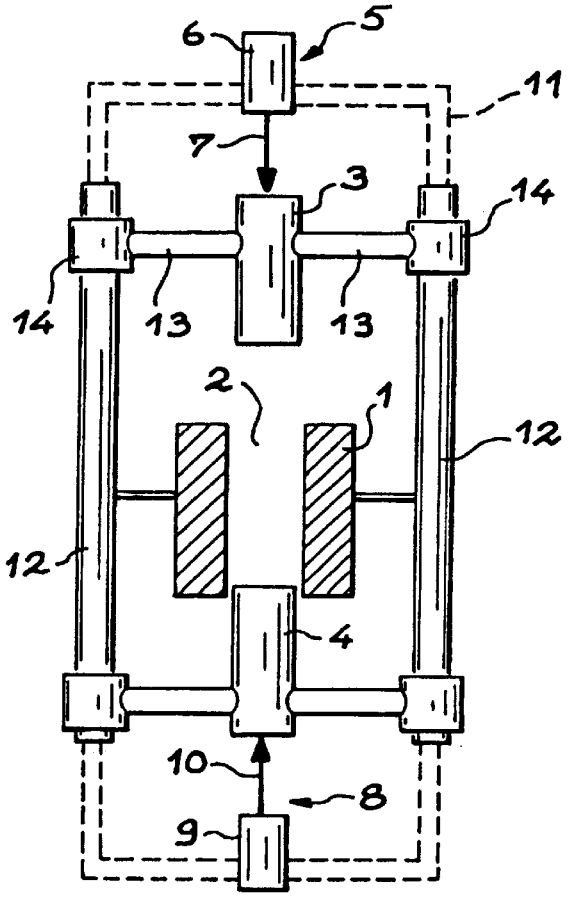
FIG. 1 PRIOR ART

More detailed explanations of the invention and its context will be given hereinafter relative to the attached drawings, wherein show:

FIG. 1 A diagram of a press for forming pellets and of a known design.

Figure 2:
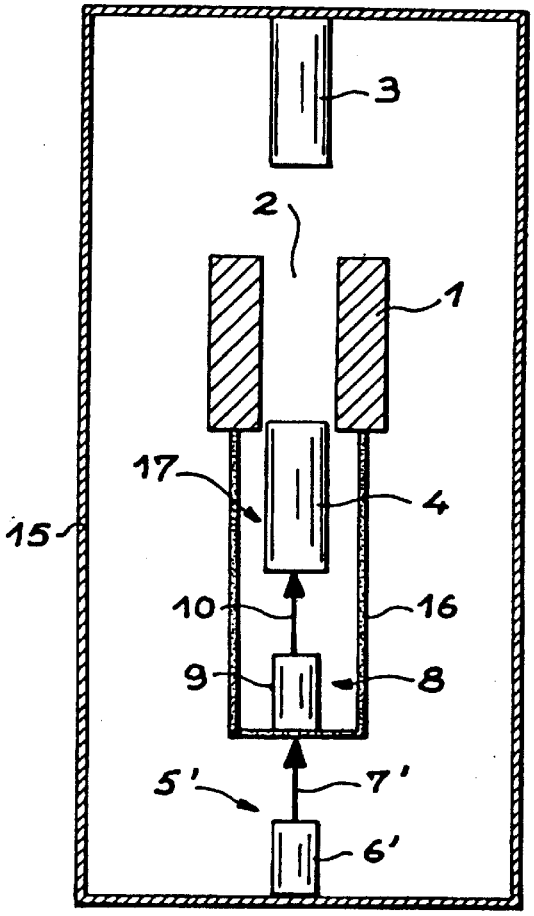

FIG. 2 A diagram corresponding to the press according to the invention.

Figure 3:
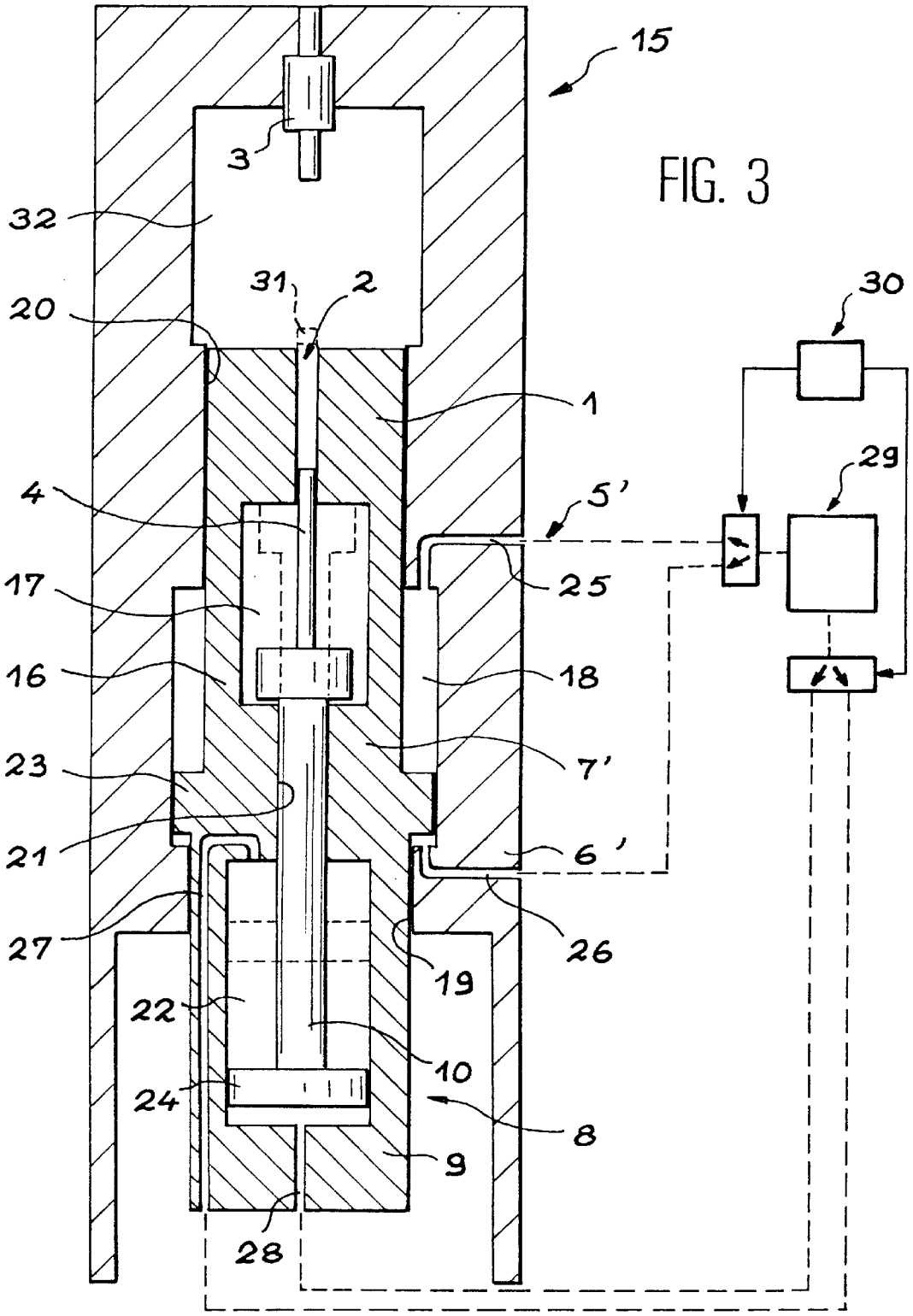

FIG. 3 A specific construction according to the invention.

The fundamental components of presses like those of FIG. 1 are a cylindrical die 1 having an opening 2 completely traversing the same, an upper punch 3, a lower punch 4, an upper jack 5 constituted by a body 6 and a rod 7, as well as a lower jack 8 constituted by a body 9 and a rod 10. The rods 7 and 10 of the jacks 5 and 8 bear on the corresponding punches 3 and 4 in order to displace them in the axis of the opening 2 and make them penetrate the latter. The position shown is that at the start of the pellet pressing cycle, where the lower punch 4 only occupies the bottom of the opening 2 and where the upper punch 3 is raised well above the die 1. It is then possible to pour the powder to be tamped into the opening 2. The following stages of the cycle consist of lowering the upper punch 3 in order to close a cavity in the opening 2 and then move the punches 3 and 4 towards one another in order to tamp the powder and form the pellet. The upper punch 3 can then be raised to return to the starting position. The lower punch 4 is raised in order to occupy the entire opening 2, projecting slightly beyond the die 1 and thus enabling the pellet to pass out of the die 1 so that it can be removed.

The die 1 is connected by a structure 11 to the bodies 6 and 9 of the jacks 5 and 8. This structure 11 comprises a pair of vertical columns 12, whose object is to guide the displacement of the punches 3 and 4, despite the large dimensions of the press. Thus, the punches 3 and 4 are integral with horizontal arms 13 terminated by bearing bushes 14 threaded onto the columns 12. It is more particularly this guidance assembly constituted by the columns 12, arms 13 and bushes 14, which is responsible for the considerable height and weight of the press, although a contribution thereto is also made by the jacks placed at the ends of the press and oriented in opposite directions.

Most of the essential components of the conventional press also appear in FIG. 2, namely the perforated die 1, the punches 3 and 4 and the jacks. However, in this case the upper jack 5 is replaced by an external jack 5' at a completely different location, beneath the other jack 8, which is here called the internal jack.

The body 6' of the external jack 5' is united with the upper punch 3 by an envelope 15, which surrounds the other components of the press, and the rod 7' of the external jack 5' is directed upwards in the same direction as the rod 10 of the internal jack 8. This rod 7' raises a sleeve 16 integral therewith, is terminated at the top by the die 1 and defines a cavity 17, where the internal jack 8 and lower punch 4 are housed, the body 9 of the internal jack 8 being fixed to the sleeve 16.

This completely different arrangement of the components of the press makes it possible to significantly reduce its dimensions (height, width, etc.), so as to facilitate and make possible its introduction e.g. into a protective enclosure of the nuclear industry. The columns 12 and other components of the aforementioned press guidance assembly have been eliminated, because a satisfactory guidance can be ensured solely with the parts shown and this is made easier because the reduced height is less likely to bring about a misalignment. The common consequence of this size reduction and simplification is that the press weight is greatly reduced and it is even possible to further reduce it by making the press from titanium, without the costs being unduly increased under favourable conditions.

Reference should be made to FIG. 3 for the study of a specific construction of the press of FIG. 2. It is possible to see three mutually mobile assemblies, the first of them, fixed in the environment, comprising the upper punch 3, the envelope 15 and the body 6' of the external jack 5', which in fact corresponds to a portion of the envelope 15 forming an external chamber 18 between two guide bearing surfaces 19 and 20. The second assembly, located in the first, comprises the die 1, sleeve 16, body 9 of the internal jack 8 and the rod 7' of the external jack 5'. Finally, the last assembly, located in the preceding assembly, comprises the rod 10 of the internal jack 8 and the lower punch 4, which are in an extension of one another. This rod 10 is guided by a bearing surface 21 of adequate length hollowed out from the rod 7', between the cavity 7 of the sleeve 16 and a chamber 22 of the body 9. As is normally the case, the chambers 18 and 22 of the jack bodies are subdivided into two parts by pistons 23 and 24 of the respective rods 7' and 10 and ducts 25, 26, 27 and 28 respectively leading into chamber portions traversing the envelope 15 or internal jack body 9. They are connected to a hydraulic system 29 formed from flexible pipes, valves and a liquid source, said hydraulic system 29 being controlled by a means 30, such as a computer, for controlling the valves, distributing the fluid to each of the chamber parts and thus obtain the desired movements of the die 1 and the lower punch 4. However, these conventional elements will not be described in detail. The considerable compactness of this press is made apparent by the following characteristics. The third assembly is entirely and constantly contained in the rod 7' of the external jack 5', apart from one end of the lower punch 4. The rod 7' of the external jack 5' is entirely or almost entirely contained in the body 6' of said external jack 5'. Finally, the die I contributes to the guidance of the rod 7' of the external jack 5', as a result of its external surface, which slides on the upper guidance surface 20 of the body 6'.

The press according to FIG. 3 is appropriate for movements equivalent to those of the known press, because, from the position shown, the die 1 and lower punch 4 are firstly raised towards the upper punch 3 until the opening 2 is closed and then the lower punch 4 is raised alone in order to tamp the powder at the desired pressure. The die 1 is then lowered, but the lower punch 4, driven back by the pressure into the chamber 22, does not follow it in its downward movement, but instead continues to rise in the opening 2 until its edge projects and the pellet 31 can be removed through a window 32 in the envelope 15. The latter state is shown in dotted line form. Finally, a pressure inversion in the internal jack 8 makes it possible to return to the initial press state.

The three, aforementioned, mutually mobile assemblies are obviously designed so as to be fittable in one another and at least some are formed from several assembled parts.

What is claimed is:

1. Press for forming pellets (31) comprising a cylindrical die (1) for forming pellets (31), two punches (3, 4) sliding in an opening (2) of the die (1) and two jacks (5', 8) comprising bodies (6', 9) and mobile rods (7', 10), a first of the punches (4) being integral with the rod (10) of a first of the jacks, characterized in that the body (9) of the first jack is integral with the die (1) and the rod (7') of the second jack, the body (6') of the second jack is integral with a second of the punches (3), the rod (10) of the first jack being guided (21) by the rod (7') of the second jack and the rod (7') of the second jack is guided (17, 20) by the body (6') of the second jack.

2. Press according to claim 1, characterized in that the body (6') of the second jack and the die (1) have cylindrical guidance surfaces (20).

3. Press according to claim 1, characterized in that the rod (10) of the first jack and the first punch (4) are entirely and constantly housed in the rod (7') of the second jack and the die (1), apart from one end of the first punch, and the rod (7') of the second jack is entirely or almost entirely housed in the body (6') of the second jack.

* * * * *